US005556043A

United States Patent [19]

Bittinger, Jr.

[11] Patent Number: 5,556,043

[45] Date of Patent: Sep. 17, 1996

[54] ANGLED-RIB BLOCKING SLAB FOR PULPWOOD GRINDER

[75] Inventor: James H. Bittinger, Jr., Duluth, Minn.

[73] Assignee: Lake Superior Paper Industries, Duluth, Minn.

[21] Appl. No.: 383,918

[22] Filed: Feb. 6, 1995

[51] Int. Cl.[6] ..... B02C 4/28

[52] U.S. Cl. ..... 241/282

[58] Field of Search ..... 241/280, 282, 241/28, 277, 151, 21, 281

[56] References Cited

U.S. PATENT DOCUMENTS 3,627,213 12/1971 Thumm ..... 241/151
3,734,419 5/1973 Cryderman ..... 241/282
4,595,150 6/1986 Aario ..... 241/282

*Primary Examiner*—Mark Rosenbaum
*Attorney, Agent, or Firm*—Westman, Champlin & Kelly, P.A.

[57] ABSTRACT

A blocking slab is used in a grinding chamber of a pulpwood grinder having a rotatable grindstone. The pulpwood grinder is suitable for reducing wood into pulp and objectionable shims and shives. The blocking slab includes a retaining side extending the length of the grindstone for permitting the passage of pulp. The blocking slab also includes a plurality of ribs forming a collecting channel proximate the retaining side and extending the length of the grindstone for collecting shims and shives therein. The plurality of ribs are angled for directing the shims and shives collected in the collecting channel toward the ends of the grindstone thus providing further reduction of the shims and shives.

18 Claims, 8 Drawing Sheets

ANGLED-RIB BLOCKING SLAB FOR PULPWOOD GRINDER

BACKGROUND OF THE INVENTION

The present invention relates generally to pulpwood grinders. Specifically, the present invention relates to a blocking slab suitable for use in such grinders.

When grinding wood in a pulpwood grinder for making pulp, or the like, wood is placed in a grinding chamber and pressed against a rotating grindstone. Essentially, the wood is ground into fibers which are passed from the grinding chamber through gaps between the walls of the grinding chamber and the grindstone. Unfortunately, shims (wood chips) and shives (splinters) also pass through the gaps. The shims and shives create a host of problems in the paper making process. For example, shims and shives can block the grinder or the piping. Also, shims and shives in pulp create an inferior product.

The pulpwood industry has, for many years, faced the problems caused by permitting shims and shives to pass with the pulp. Despite the recognition of such problems, however, the techniques used within the industry to eliminate shims and shives from the pulp have been heretofore less than successful.

For example, one attempted solution is to screen the pulp to eliminate the shims and shives. However, screening the pulp introduces inefficiencies in the pulp making process because it impedes the flow of pulp. Screening also requires an attendant and thus results in added labor and costs.

Certain types of finger bars have also been used. Finger bars with a series of rake-like fingers are shown in U.S. Pat. No. 3,734,419. Such finger bars have been secured closely spaced apart from the grindstone in the gap. Such finger bars do not adequately impede the passage of shims or shives. Thus, the pulpwood industry has long considered finger bars inadequate.

Blocking slabs with long narrow strips placed in the gap proximate the grindstone and parallel to the axis of the grindstone have also been tried, but are less than adequate. U.S. Pat. No. 4,595,150 shows a typical blocking slab having a series of longitudinally-oriented, spaced-apart ribs parallel to the axis of the grindstone. The ribs form a series of recesses therebetween and parallel to the axis of the grindstone.

During use, the recesses of the typical blocking slab quickly become packed full of shims, shives and pulp which creates a seal between the blocking slab and the grindstone. Blocking slabs consequently impede the passage of pulp through the gap and significantly reduce pulp making efficiency. The grinder is required to expend more energy to pass pulp through the seal. Further, downtime can result when the grinder is stopped to clear the seal formed in the recesses.

SUMMARY OF THE INVENTION

The present invention is directed to a blocking slab for use in a grinding chamber of a pulpwood grinder having a rotatable grindstone. The pulpwood grinder is suitable for reducing wood into pulp. The blocking slab includes a retaining side extending the length of the grindstone for permitting the passage of pulp and preventing the passage of the wood. The blocking slab also includes a plurality of ribs forming a collecting channel proximate the retaining side and extending the length of the grindstone for collecting shims and shives therein. The plurality of ribs are angled for directing the shims and shives collected in the collecting channel toward the ends of the grindstone thus providing further reduction of the shims and shives and preventing a seal of shims and shives from forming between the blocking slab and the grindstone.

DETAILED DESCRIPTION OF THE PREFERRED EMBODIMENTS

Figure 1:
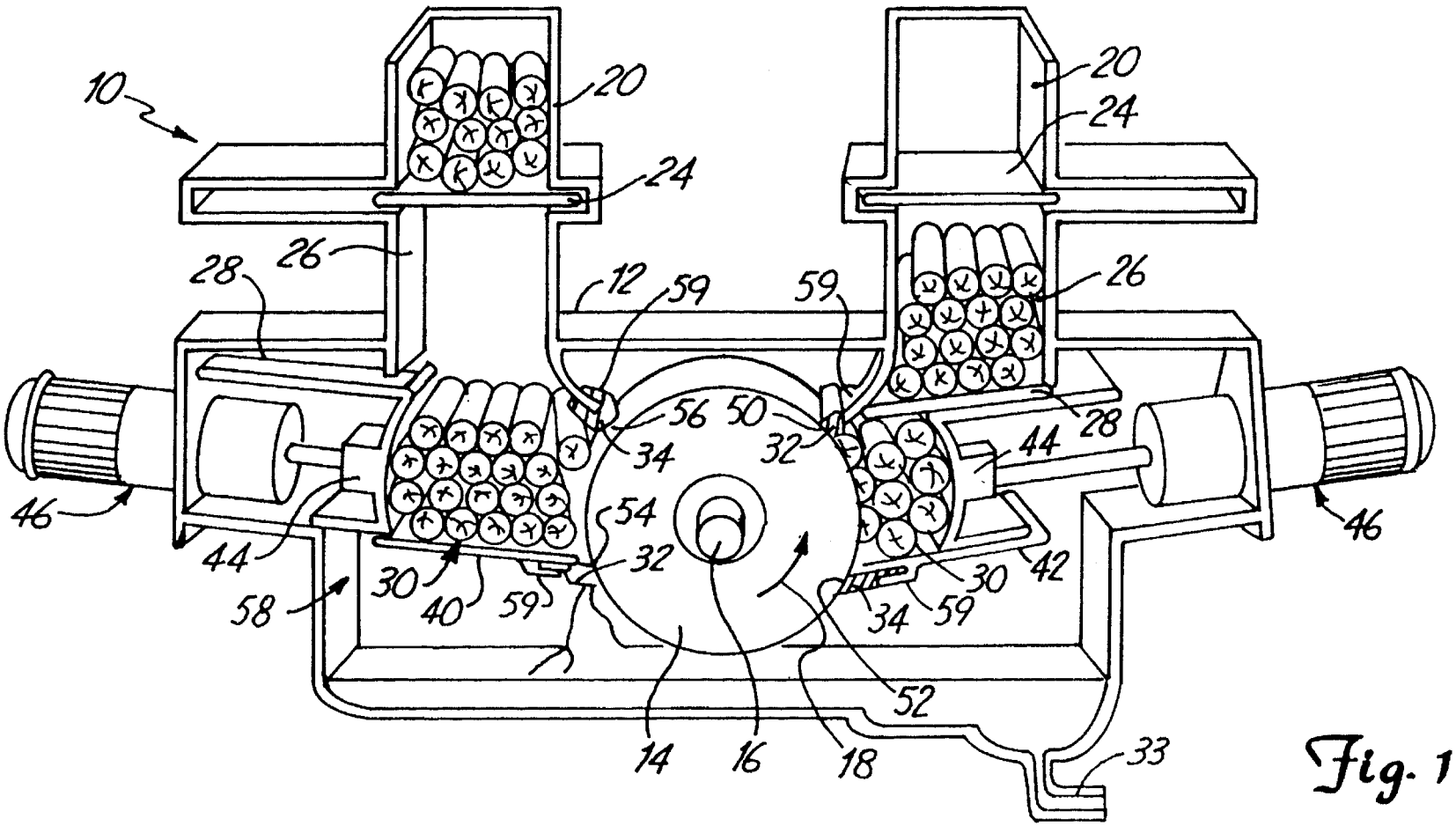
FIG. 1 is a schematic view of a vertical section of a pulpwood grinder provided with blocking slabs embodying features of the present invention.

A pulpwood grinder is shown in FIG. 1 and indicated generally by reference numeral 10. The pulpwood grinder 10 comprises a frame 12 having a rotatably mounted grindstone 14. The grindstone 14 is secured to an axle 16 and typically driven by 7,000 HP electric motors (not shown) and, in one preferred mode, rotates in the direction shown by arrow 18. The abrasive peripheral surface of the grindstone 14 reduces the logs pressed thereagainst into pulp.

A magazine 20 for storing a charge of logs, pulpwood bolts, or the like, to be reduced is situated above the grindstone 14. The charge of logs rests on a removable charging deck 24 which slides out of the way to permit the logs to enter a feed chamber 26 having a gate 28. When the grinder 10 is prepared to reduce the logs, the gate 28 opens and the logs are deposited into grinding chambers 30.

The grinding chambers 30 are provided with blocking slabs 32, 34 affixed to the frame 12 and lower walls 40, 42, the particular arrangement of which is described below. Pressure shoes 44 are connected to hydraulic pistons 46 for pressing the charge of logs in the grinding chamber 30 against a peripheral face of the grindstone 14. The grindstone 14 reduces the logs to pulp which then passes via gravity through gaps 52, 54, between the blocking slabs 32, 34 and the grindstone 14. The pulp is collected in a pit 58 below the grinder 10, formed into a slurry, and pumped through exit 33 to further processing.

Figure 2:
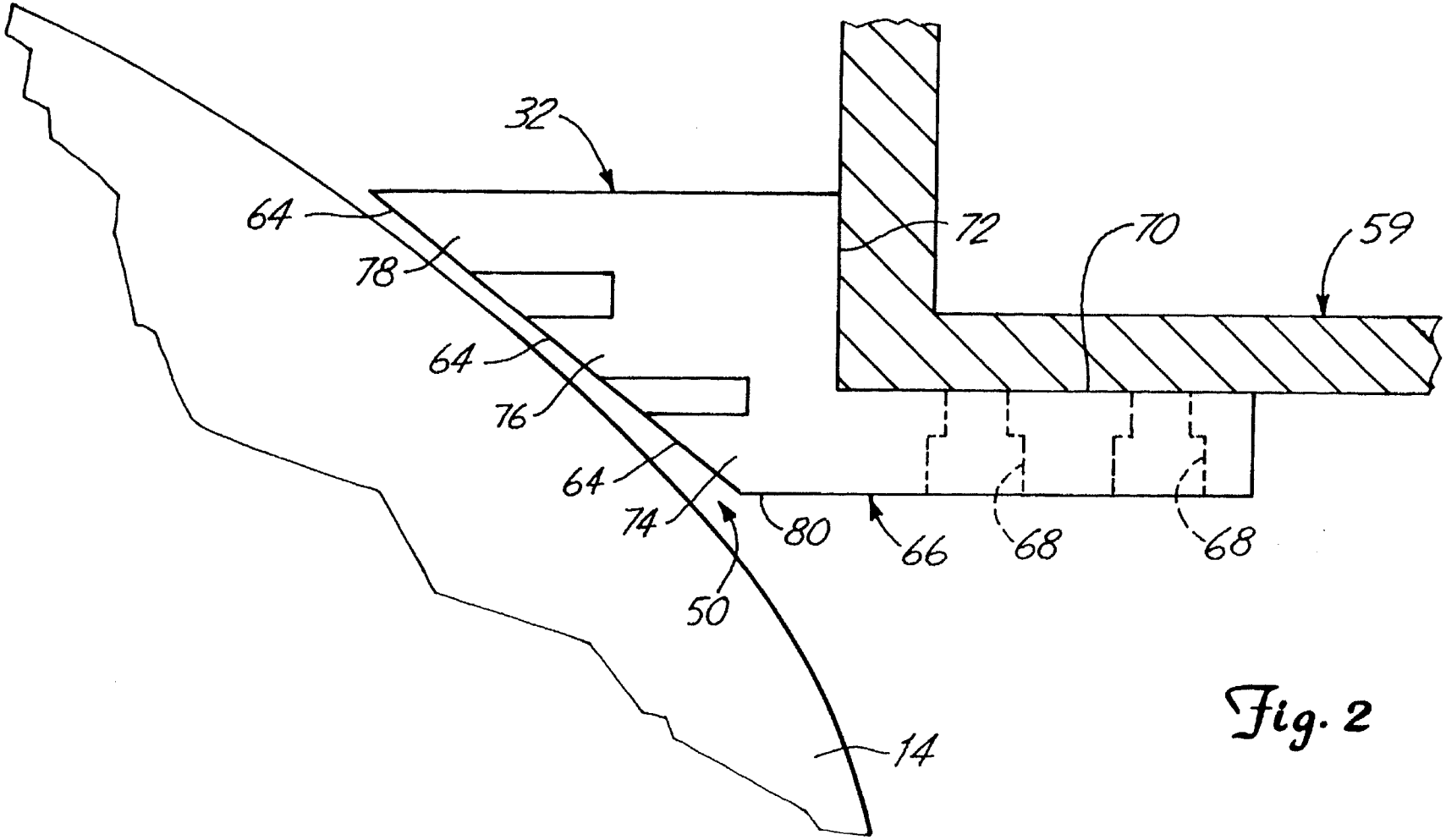
FIG. 2 is a more detailed schematic view of a section of FIG. 1.

Affixed to the upper and lower inner-extremities of each grinding chamber 30, adjacent the periphery of grindstone 14, are dissimilar pairs of circumferentially spaced, upper and lower blocking slabs 32, 34 respectively. FIG. 2 shows that the blocking slabs 32, 34 are adapted to be secured to carriers 59 supported by the frame 12. Carriers 59 are preferably movable in order to adjust the gaps 50, 52, 54 or 56 between the grindstone 14 and the blocking slabs 32, 34 to be at a preferred, known distance. The blocking slabs 32, 34 can be affixed to the carrier 59 with any suitable connector, such as cap screws or the like.

Figure 3:
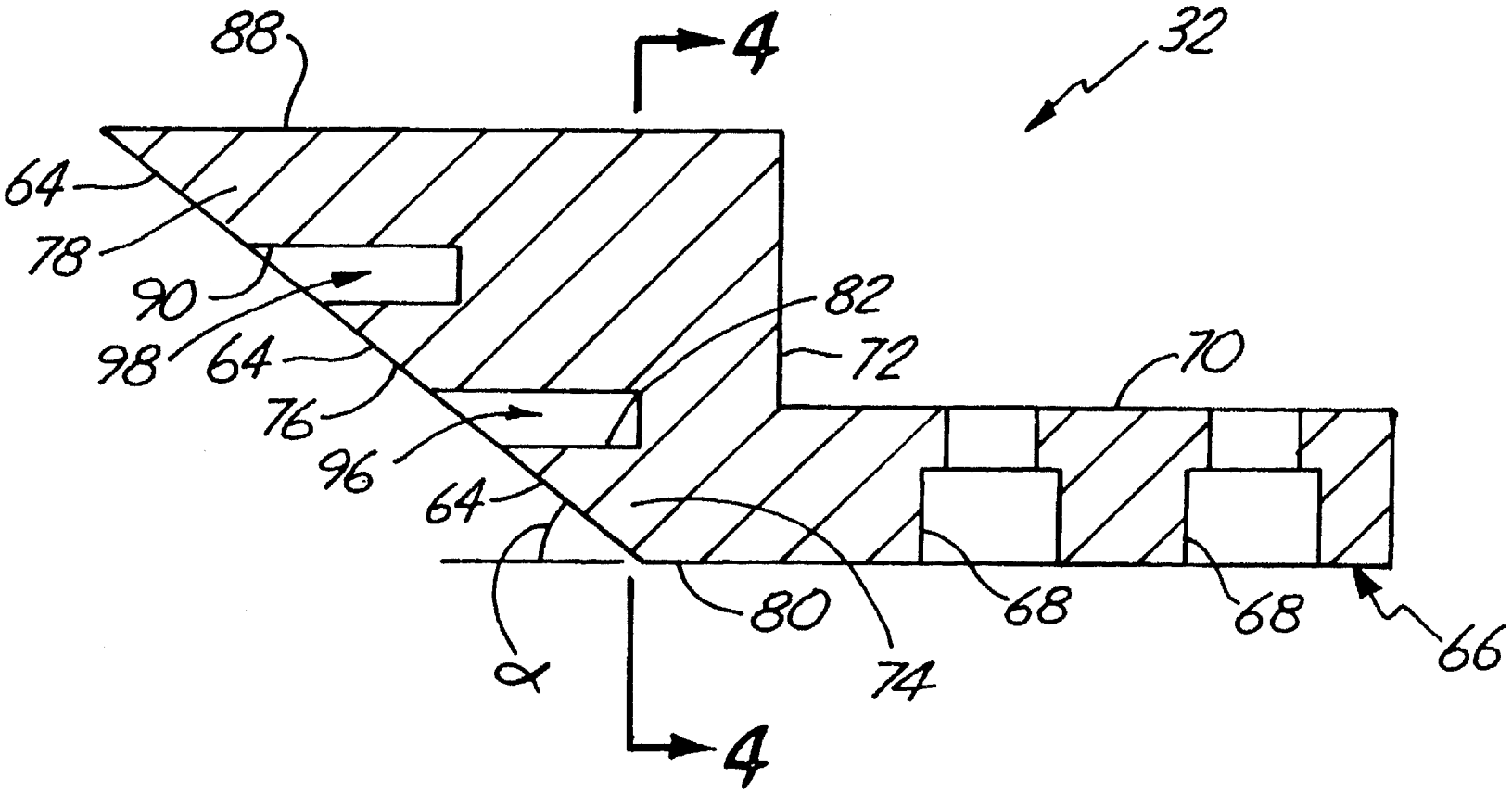
FIG. 3 is a side view of a first embodiment of a blocking slab of the present invention as shown in FIG. 1, and sectioned for clarity.
Figure 4:
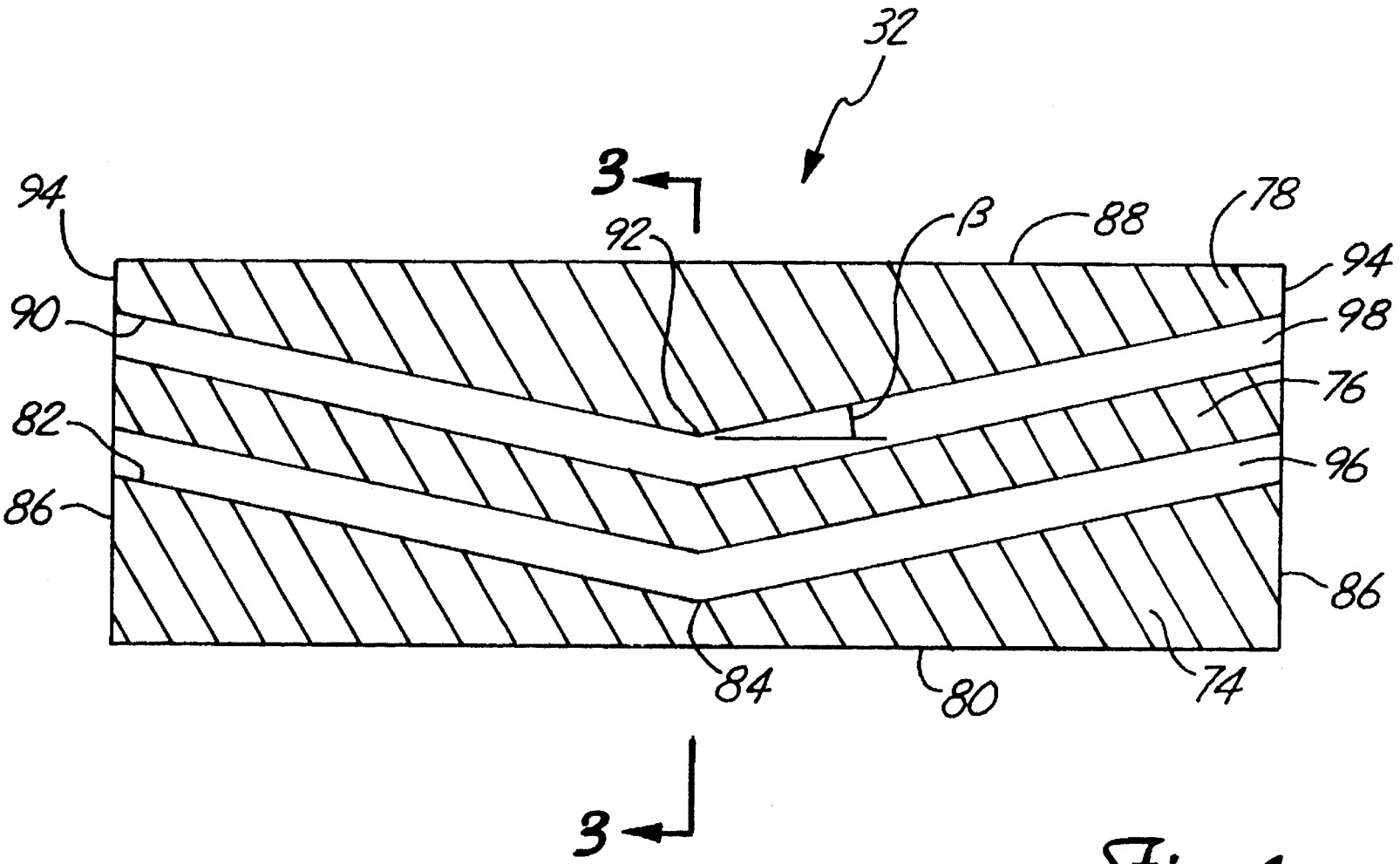
FIG. 4 is a front view of the blocking slab of FIG. 2, and sectioned for clarity.
Figure 4A:
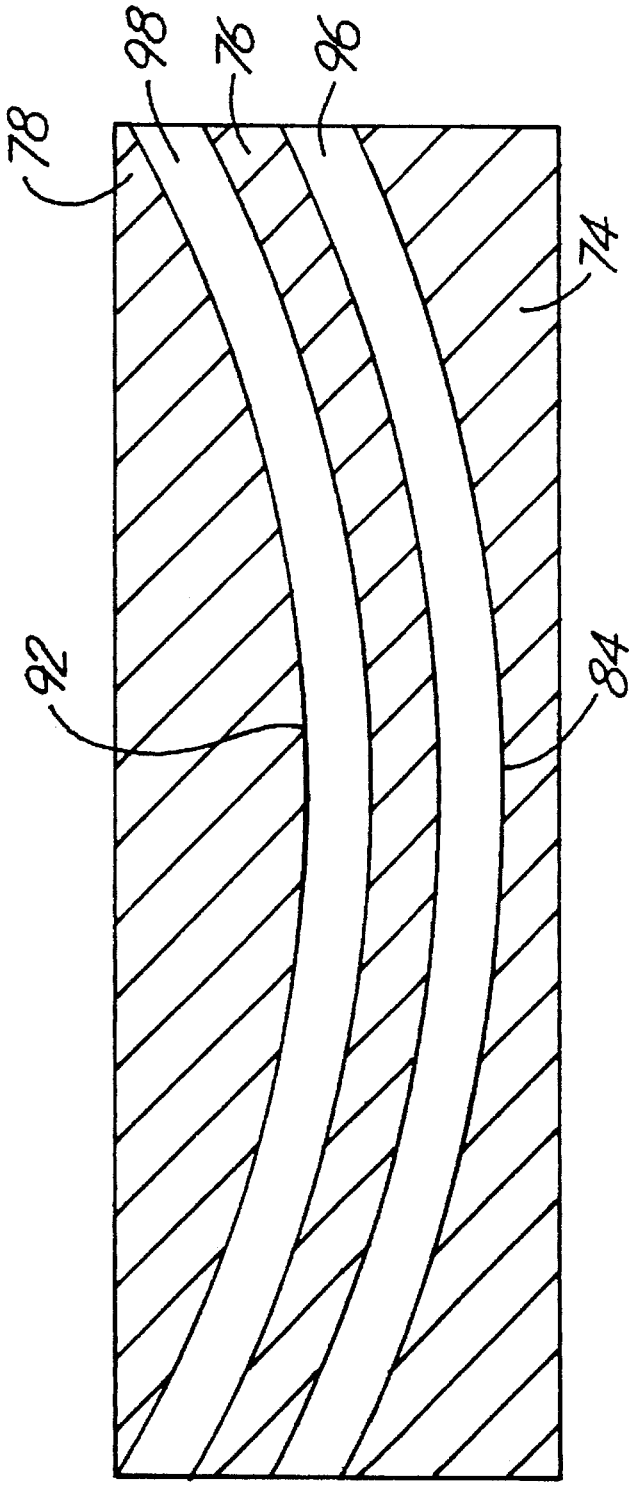
FIG. 4A is a front view of another embodiment of the present invention, sectioned for clarity.
Figure 5:
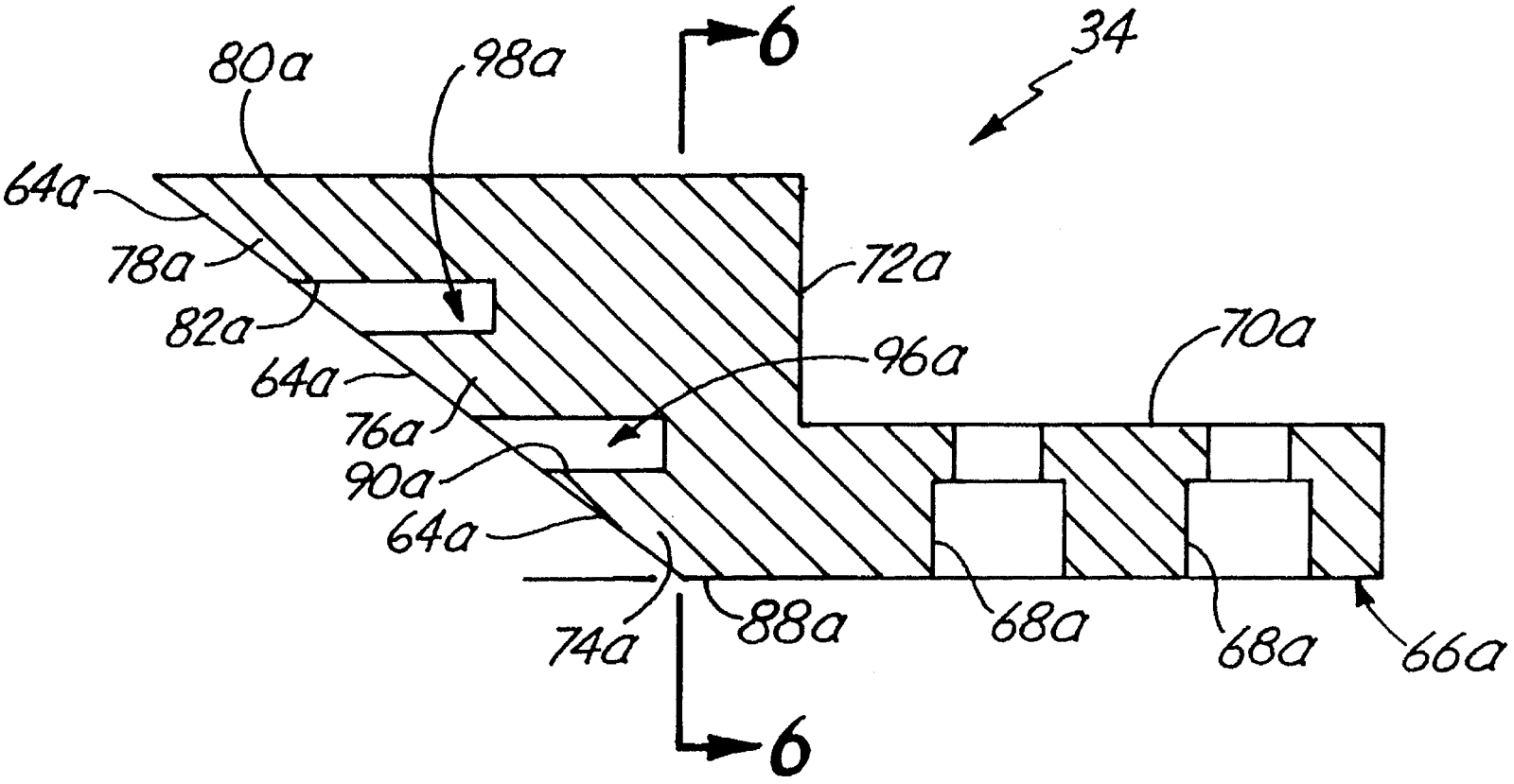
FIG. 5 is a side view of a second embodiment of a blocking slab of the present invention as shown in FIG. 1, and sectioned for clarity.
Figure 6:
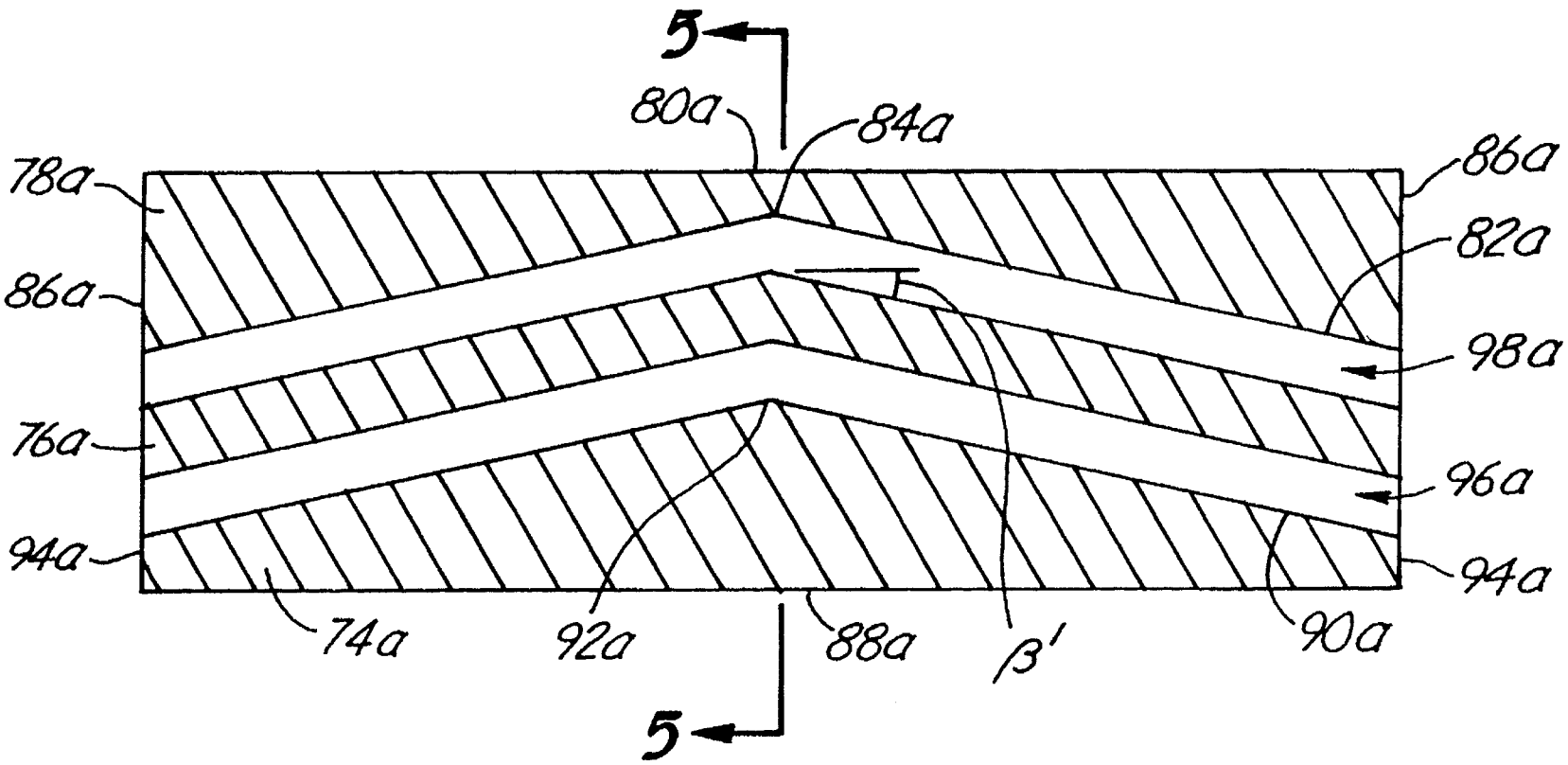
FIG. 6 is a front view of the blocking slab of FIG. 5, and sectioned for clarity.
Figure 6A:
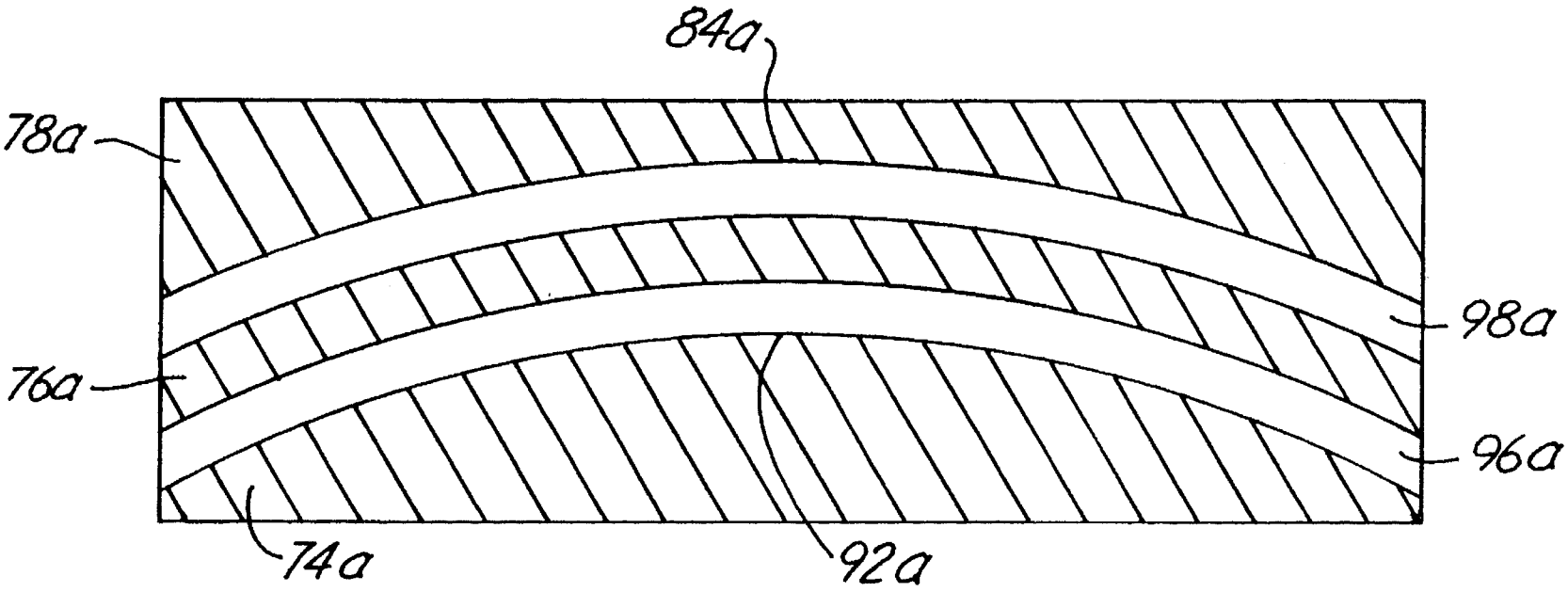
FIG. 6A is a front view of another embodiment of the present invention, sectioned for clarity.

The blocking slabs 32 can be considered to trail the leading blocking slabs 34 in the direction of rotation 18. According to a preferred embodiment of the present invention, the trailing blocking slabs 32 are uniquely constructed as compared to the leading blocking slabs 34. A trailing blocking slab 32 is shown in FIGS. 3, 4 and 4A. A leading blocking slab 34 is shown in FIGS. 5, 6 and 6A.

FIG. 3 shows that the trailing blocking slabs 32 include a longitudinal fastening member 66 having a plurality of bores 68 and a generally planar longitudinal fastening surface 70. The bores 68 are suitable for accepting a cap screw. The bores 68 are preferably counter bores such that the head of cap screws are recessed within the longitudinal fastening member 66.

A generally planar vertical support surface 72 is provided adjacent the longitudinal fastening surface 70. Trailing blocking slabs 32 are secured against carriers 59 at the fastening surfaces 70, 72, and secured in place by the cap screws in bores 68.

Trailing blocking slabs 32 are formed of a strip-like member which preferably extends the length of grindstone 14. Also, trailing blocking slabs 32 comprise a plurality of retaining ribs defining a plurality of channels which are discussed in detail below. The ribs are stepped at an angle $\alpha$, preferably 38°, relative to the longitudinal fastening member 66, so that all of the ribs reach almost to the peripheral surface of a typical 71" (180 centimeter) diameter grindstone 14 when the trailing blocking slabs 32 are mounted to the respective carriers 59. Rib ends 64 are preferably adapted to be substantially co-planar.

FIGS. 3 shows that each trailing blocking slab 32 preferably comprises a short rib 74, center rib 76, and long rib 78, as measured from the vertical support surface 72. The short rib 74 comprises a retaining side 80, which is adapted to face into the grinding chamber 30 and is generally planar. The trailing blocking slab 32 is adapted to be affixed to the carrier 59 so that the retaining side 80 is generally parallel to the axis of rotation of the grindstone 14. The short rib 74 also comprises a trailing side 82 opposite the retaining side 80.

The long rib 78 comprises a remote side 88, which is opposite the retaiming side 80. The long rib 78 is generally planar, extends the length of the trailing blocking slab 32, and is parallel to the retaining side 80. The long rib 78 also comprises a leading side 90 facing generally into the grinding chamber 30 and opposite the remote side 88.

FIGS. 4 and 4A are front views of two embodiments of blocking slab 32 and show that the trailing side 82 is preferably V-shaped or convex along the length of the grindstone 14, having an apex 84 in the center and two ends 86. For the purposes of this disclosure, "convex" is intended to include a continuously curved rib as shown in FIG. 4A, an angled rib as shown in FIG. 4, or any suitable derivation or combination thereof. In the embodiment shown in FIG. 4A, parts similar to that shown in the embodiment of FIG. 4 have similar reference numerals. The distance from the retaining side 80 to the apex 84 is preferably shorter than the distance from the retaining side 80 to the ends 86. The angle $\beta$ of the legs of the "V" is greatly exaggerated for clarity, but is preferably 1.5° relative to retaining side 80.

FIG. 4 also shows that the leading side 90 of long rib 78 is preferably V-shaped, or convex, having an apex 92 in the center and two ends 94. The distance from the remote side 88 to the apex 92 is preferably longer than the distance from the remote side 88 to the ends 94. The V-shaped center rib 76 is positioned between the long rib 78 and the short rib 76. The center rib 76 forms a first channel 96 between the center rib 76 and the short rib 74, and a second channel 98 between the center rib 76 and the long rib 78. Channels 96, 98 are preferably open along the entire length of the trailing blocking slab 32.

FIG. 5 is a sectional view of leading blocking slab 34 and shows that leading blocking slab 34 includes a longitudinal fastening member **66*a* having a plurality of bores 68*a* and a generally planar longitudinal fastening surface 70*a*. The bores 68*a* are suitable for accepting a cap screw. The bores 68*a* are preferably counterbores such that the head of the cap screws are recessed within the longitudinal fastening member 66*a***.

A generally planar vertical support surface **72*a* is provided adjacent the longitudinal fastening surface 70*a*. Leading block slabs 34 are secured against carriers 59 at the fastening surfaces 70*a*, 72*a***, and secured in place.

Leading blocking slabs 34 are also preferably formed of a strip-like member which extends the length of the grindstone 14. Leading blocking slabs 34 comprise a plurality of retaining ribs defining a plurality of channels which are discussed in detail below. The ribs are stepped at an angle $\alpha'$ (preferably 38°) relative the longitudinal fastening member **66*a*, so that all of the ribs reach almost to the peripheral surface of a typical 71" (180 cm) diameter grindstone 14 when the leading blocking slabs 34 are mounted to the respective carriers 59. Rib ends 64*a*** are preferably adapted to be substantially co-planar.

Each leading blocking slab 34 preferably comprises a short rib **74*a*, center rib 76*a*, and long rib 78*a* as measured from the verticle support surface 72*a*. The long rib 78*a* comprises a retaining side 80*a* which is opposite the grinding chamber 30 and is generally planar. The leading block slab 34 is adapted to be affixed to the carrier 59 so that the retaining side 80*a* is parallel with the axis of rotation of the grindstone 14. The long rib 78*a* also comprises a trailing side 82*a* opposite the retaining side 80*a***.

Also, the short rib **74*a* comprises a remote side 88*a* which is opposite the retaining side 80*a* and adapted to face into the grinding chamber 30. The remote side 88*a* is generally planar, extends the length of the blocking slab 34, and is parallel to the retaining side 80*a*. The short rib 74*a* also comprises a leading side 90*a* facing opposite the grinding chamber 30**.

FIGS. 6 and 6A are front sectional views of two embodiments of leading blocking slab 34 and show that the trailing side **82*a* is preferably A-shaped, or convex, having an apex 84*a* in the center and two ends 86*a*. Again, for the purposes of this disclosure, "convex" is intended to include a "continuous curve" rib as shown in FIG. 6A, an angled rib as shown in FIG. 6, or any suitable derivation thereof. In the embodiment shown in FIG. 6A, parts similar to that shown in the embodiment of FIG. 6 are shown with similar reference numbers. The distance from the retaining side 80*a* to the apex 84*a* is preferably longer than the distance from the retaining side 80*a* to the ends 86*a*. The angle $\beta'$ of the legs of the "A" is shown exaggerated in FIG. 6 for the sake of clarity, but is preferably 1.5° relative retaining side 80*a***.

Further, leading side **90*a* is preferably A-shaped, or convex, having an apex 92*a* in the center and two ends 94*a*. The distance from the remote side 88*a* to the apex is preferably shorter than the distance from the remote side 88*a* to the ends 94*a*. A-shaped center rib 76*a* is positioned between the long rib 78***a* and the short rib 74*a*. The center rib 76*a* forms a first channel 96*a* between the center rib 76*a* and the short rib 74*a*, and a second channel 98*a* between the center rib 76*a* and the long rib 78*a*. The channels 96*a*, 98*a* are preferably open along the entire length of the leading blocking slab 34.

The retaining sides 80, 80*a* of blocking slabs 32 and 34 are positioned sufficiently close to the peripheral surface of the grindstone 14 to retain a preponderance of shims and shives. The blocking slabs 32, 34, however, are spaced from grindstone 14 to provide gaps 52, 54 to pass fully ground pulp. The ribs and channels are oriented to capture objectionable shims and shives that advance past the retaining sides 80, 80*a*. The apexes 84, 84*a*, 92, 92*a* of the ribs are directed into the direction of rotation of the grindstone 18 (i.e., the ribs and channels are directed against the direction of rotation). Shims and shives trapped in the channels 96, 96*a*, 98, 98*a* are thus subject to a translational component of force from the rotating grindstone 14 and the inwardly directed pressure shoes 44. The translational force causes a high pressure area to develop at the apexes which, in turn, forces the shims and shives toward the ends of the grindstone 14 along ribs 74, 74*a*, 76, 76*a*, 78, 78*a*. While traveling along the ribs 74, 74*a*, 76, 76*a*, 78, 78*a*, the shims and shives undergo additional grinding and further reduction. Additionally, directing the shims and shives toward the ends maintains the gap 50, 52, 54, 56 in the center of the grindstone which permits pulp to continuously pass. The material used to fabricate the blocking slabs 32, 34 must be sufficiently strong to withstand the rigors of use, and is preferably series 316 stainless steel, or other suitable material.

In operation, (with reference again to FIG. 1) the magazine 20 is loaded with a charge of logs, typically from a conveyor (not shown). The charging deck 24 opens to fill the feed chamber 26 full of logs. The charging deck 24 then closes. The lower gate 28 opens and the logs are deposited in the grinding chambers 30. The hydraulic pistons 46 direct the shoes 44 inwardly, urging the logs against the peripheral face of the grindstone 14. The abrasive face of the grindstone 14 reduces the logs to pulp and objectionable shims and shives. The pulp falls through the gaps 50, 52, 54, 56 into the tank 58. The series of longitudinally placed ribs and channels, however, impede shims and shives from moving past the blocking slabs 32, 34. The apexes 84, 84*a*, 92, 92*a* preferably face into the direction of the rotation of the grindstone 18 (i.e., the ribs and channels are directed against the direction of rotation) and direct the shims and shives into the channels where the shims and shives are free to move therein. The channels and ribs direct the shims and shives, under pressure from the shoes 44 and subject to the rotating grindstone 14, toward axial ends of the blocking slab 32, 34. While moving along the ribs and channels, the shims and shives are urged against the grindstone 14 and undergo further reduction to pulp, thus preventing build-up in the gap.

The previously described versions of the present invention have many advantages, including providing a strong blocking slab that provides further reduction of shims and shives trapped therein and which resists build-up of objectionable shims and shives. The ribs and angled rib ends 61 provide additional collecting surfaces to handle large amounts of shims and shives entering the gaps. Further, the V-shaped channels and ribs cause the shims and shives to move toward the ends of the blocking slab and inhibit seal formation in the gaps. Thus, more pulp is passed to the tank in the same amount of time as compared to other blocking slabs. This feature conserves resources wherein a larger percentage of wood is reduced into usable pulp and less energy is expended in operating the grindstone as compared with other blocking slabs and finger bars. Although it is desirable to pass pulp only through gaps 52 and 54, placement of the four blocking slabs allows reduction to occur at all possible exit points of the grinding chamber.

Although the present invention has been described with reference to preferred embodiments, workers skilled in the art will recognize that changes may be made in form and detail without departing from the spirit and scope of the invention.

What is claimed is:

1. A pulpwood grinder having: a frame; a grindstone for rotation in a direction of travel; and a blocking slab, the blocking slab comprising:

a first rib extending the length of the grindstone and having a convex leading side with an apex;

wherein the rib is affixable to the frame proximate the grindstone such that the leading side and the apex are arranged opposing the direction of travel; and wherein the rib includes a trailing side opposite the leading side.

2. The pulpwood grinder of claim 1 wherein the blocking slab further comprises:

a second rib extending the length of the grindstone, the second rib having a leading side and being affixed to the first rib so that the leading side of the second rib and the trailing side of the first rib form a first channel therebetween, wherein the first channel extends the length of the grindstone.

3. The pulpwood grinder of claim 2 wherein the ribs and channels of the blocking slab are angled.

4. The pulpwood grinder of claim 2 wherein the first and second ribs of the blocking slab are attached to a support on the blocking slab and are stepped, the first rib protruding further than the second rib relative to the support.

5. The pulpwood grinder of claim 2 wherein the first and second ribs of the blocking slab are attached to a support on the blocking slab and are stepped, the second rib protruding further than the first rib relative to the support.

6. The pulpwood grinder of claim 1 wherein the grindstone has a surface with a curvature and wherein the first rib of the blocking slab includes a generally planar rib-end which approximates a portion of the curvature of the grindstone.

7. A pulpwood grinder including a rotatably mounted grindstone having an axis of rotation and a direction of travel and a blocking slab proximate the grindstone, the blocking slab comprising:

a plurality of longitudinally spaced-apart convex ribs each having two axial ends and an intermediate portion therebetween, wherein a first rib includes a retaining side generally parallel to the axis of rotation and a second rib includes a remote side generally parallel to the axis of rotation;

the ribs defining at least one convex channel therebetween and extending the length of the grindstone;

wherein each channel forms an apex in the intermediate portion such that the channel is proximate the retaining side relative to the remote side at the apex and extends from the apex generally toward the axial ends and toward the remote side.

8. The pulpwood grinder of claim 7 wherein the ribs and channels of the blocking slab are angled.

9. The pulpwood grinder of claim 7 wherein the ribs and channels of the blocking slab are continuously curved.

10. The pulpwood grinder of claim 7 wherein the blocking slab further comprises:

a generally longitudinal fastening member extending substantially the length of the ribs and affixed to the ribs; and a transverse support surface adjacent to the longitudinal fastening member supporting the ribs.

11. The pulpwood grinder of claim 7 wherein the ribs of the blocking slab are stepped such that the first rib protrudes past the second rib.

12. The pulpwood grinder of claim 7 wherein the ribs of the blocking slab are stepped such that the second rib protrudes past the first rib.

13. The pulpwood grinder of claim 7 wherein each rib of the blocking slab includes a rib end adapted for generally facing the grindstone.

14. A pulpwood grinder suitable for reducing wood into pulp and shives, the pulpwood grinder having a rotatable grindstone with two ends; and a blocking slab, the blocking slab comprising:

a retaining side affixed to the grinding chamber proximate the grindstone and extending the length of the grindstone for permitting the passage of the pulp between the grindstone and the blocking slab and preventing the passage of the wood of a selected size; and a rib extending the length of the grindstone and forming a collecting channel, the collecting channel operably connected to the retaining side and extending the length of the grindstone, for collecting the shives;

wherein the rib and collecting channel are angled for directing the shives collected in the collecting channel toward the ends of the grindstone.

15. A pulpwood grinder comprising:

a grinding chamber;

a grindstone having two ends and a direction of rotation wherein the grindstone is rotatably mounted proximate the grinding chamber; and a plurality of blocking slabs affixed to the grinding chamber and proximate the grindstone wherein the blocking slabs include a first convex rib extending the length of the grindstone.

16. The pulpwood grinder of claim 15 wherein each blocking slab further includes:

a retaining rib proximate the first convex rib and forming a first channel therebetween;

a second convex rib proximate the first convex rib and forming a second channel therebetween wherein the ribs and channels extend the length of the grindstone; and a support member having a plurality of support surfaces, the support member affixed to the ribs.

17. The pulpwood grinder of claim 16 wherein the ribs and channels are directed against the direction of rotation.

18. The pulpwood grinder of claim 15 wherein the first convex rib is directed against the direction of rotation.

* * * * *